United States Patent [19]

Choi

[11] Patent Number: 4,826,244

[45] Date of Patent: May 2, 1989

[54] PORTABLE TABLE

[76] Inventor: Moo W. Choi, 1615-1 Bong Chun-Dong, Kwan ack-ku, Seoul, Rep. of Korea

[21] Appl. No.: 178,420

[22] Filed: Apr. 6, 1988

[30] Foreign Application Priority Data

| | | | |
|---|---|---|---|
| Apr. 8, 1987 | [KR] | Rep. of Korea | 4826/87[U] |
| Apr. 8, 1987 | [KR] | Rep. of Korea | 4827/87[U] |
| Apr. 8, 1987 | [KR] | Rep. of Korea | 4828/87[U] |
| Apr. 8, 1987 | [KR] | Rep. of Korea | 4829/87[U] |
| Apr. 11, 1987 | [KR] | Rep. of Korea | 5142/87[U] |

[51] Int. Cl.[4] ..... A47B 3/14

[52] U.S. Cl. ..... 297/159; 108/35; 108/38; 292/175; 297/17; 297/139

[58] Field of Search ..... 297/159.17, 157, 440, 297/139; 108/34, 35, 38; 292/175, 163, DIG. 48, DIG. 50

[56] References Cited

U.S. PATENT DOCUMENTS

| | | | |
|---|---|---|---|
| 179,749 | 7/1876 | Weiss | 292/175 X |
| 186,746 | 1/1877 | Mix | 292/175 |
| 2,897,666 | 8/1959 | Gumport | 292/163 X |
| 4,462,636 | 7/1984 | Markson | 297/438 X |
| 4,653,804 | 3/1987 | Yoo et al. | 297/159 |
| 4,700,987 | 10/1987 | Sraka et al. | 297/159 |

*Primary Examiner*—Peter A. Aschenbrenner
*Assistant Examiner*—Thomas A. Rendos
*Attorney, Agent, or Firm*—David H. Semmes

[57] ABSTRACT

A portable table and chairs therefor which may be foldable for carrying, but used in the extended mode as a table primarily for the outdoors, such as at the beach, etc. The table having chairs attached includes folding arms which are connected to legs of the folding chairs and also includes a supporting rod to enable the folding of the legs. It also highlights a foldable supporting element which connects table and folding chairs to each other. Protected hinges are provided to allow half-folding of table sections and locking means therefor are provided to maintain, with the hinges the shape of a container when table sections may be half-folded.

2 Claims, 9 Drawing Sheets

FIG. 4
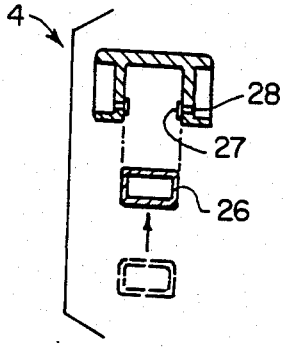
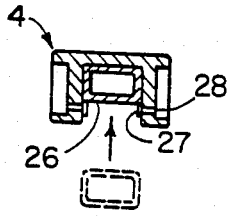
FIG. 5
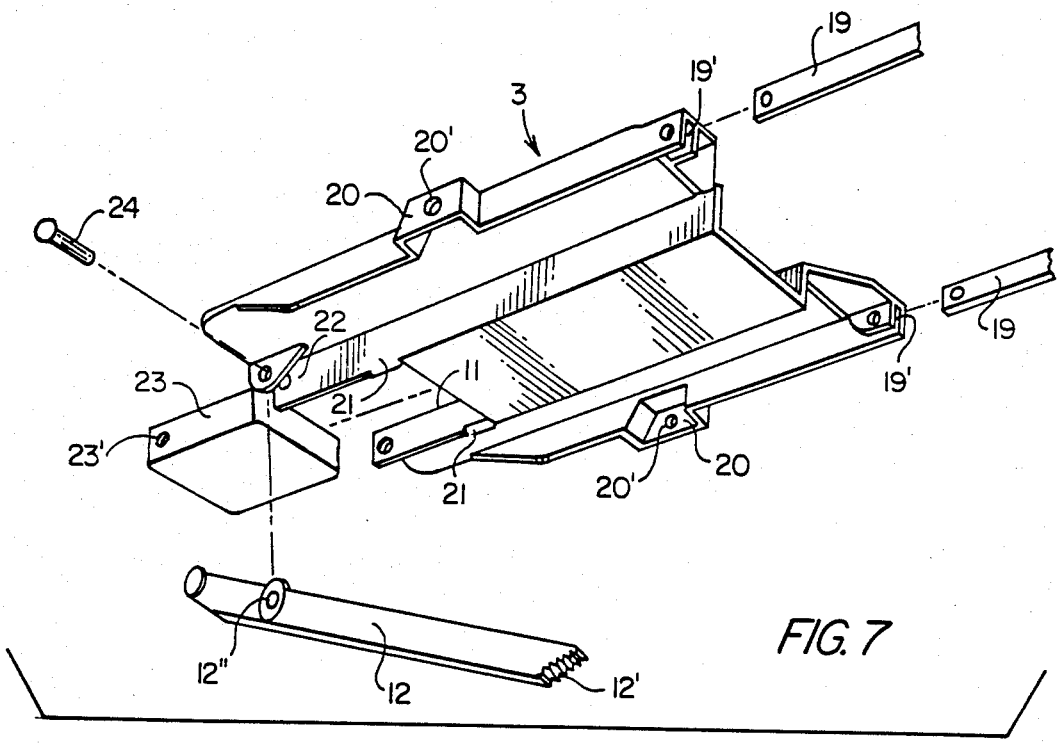
FIG. 7
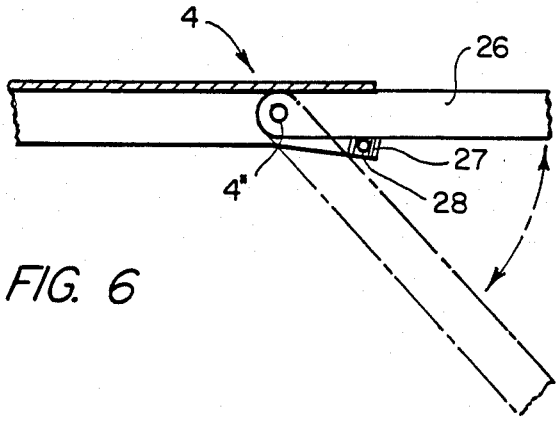
FIG. 6

FIG. 18
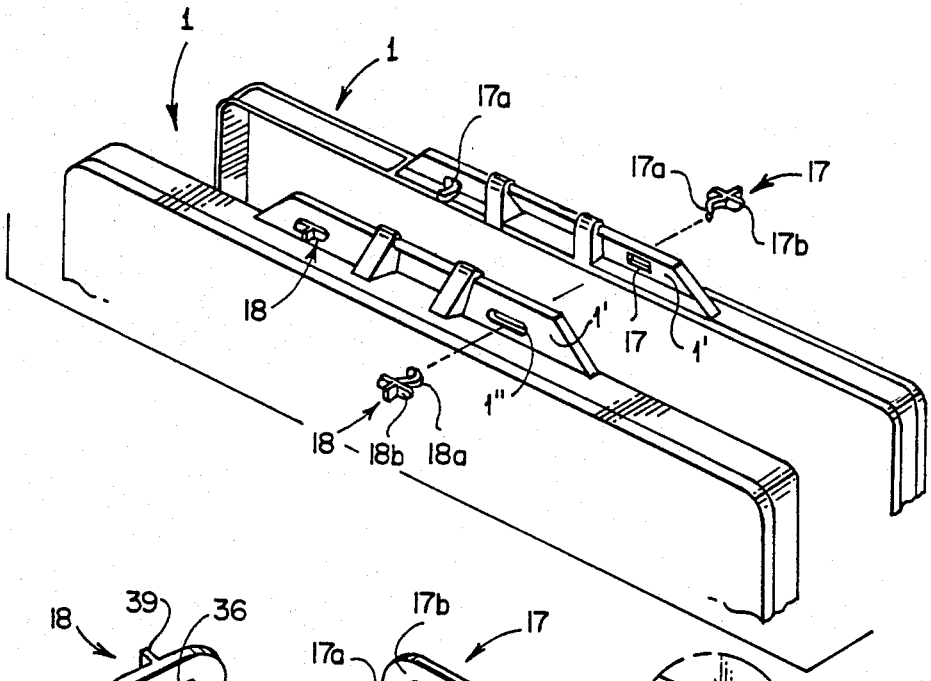
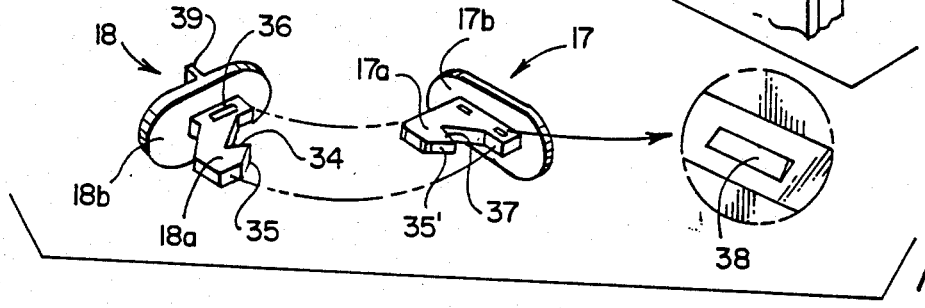
FIG. 19
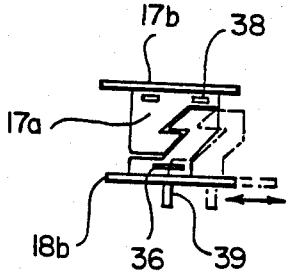
FIG. 20

PORTABLE TABLE

CROSS-REFERENCE TO RELATED APPLICATIONS

Prior foreign application Nos. 4826/4827/4828/4829/5142/ Korea, Apr. 8, 1987 and Apr. 11, 1987 under the name of inventor Moo Woong Choi.

BACKGROUND OF THE INVENTION

1. Field of the Ivention

This invention relates to an improvement in conventional portable tables.

"Portable Table" means that a table and simplified chairs herein form an integral body wherein as the table may be folded in half, it becomes a portable self contained compartment, box container with chairs being stored therein, whereby they may be inserted in a car truck, thereby allowing the alternate storage and use of the table in the outdoors or the sea side, etc.

2. Description of the Related Art Including Information Disclosed

The prior art is disclosed by U.S. Pat. No. 4,653,804.

SUMMARY OF THE INVENTION

This invention relates to an improvement of a portable table of prior invention of U.S. Pat. No. 4,653,804 issued to the same applicant of this invention. More particularly it comprises the folding arms for securely supporting table and chair legs and the seat plate when the folding chair may be stretched or extended into utility position; the foldable supporting means for connecting the table and the folding chairs to each other and the folding of them; the seat plate of the folding chairs; the hinge means allowing half-folding of the table;

the locking means for maintaining the shape of the compartment when the table is half-folded; the folding arm is connected to the legs of associated folding chairs and supporting rod. Heretofor there was used a simple triangular shaped metal pipe or a synthetic resin arm. At the engaging portion formed between the supporting rods there protruded a hooking projection. Thus when the supporting rod was engaged with the folding arm, the coupling operation of the supporting rod and the folding arm was accompanied by a slightly elastic force produced as the engaging portions of said arm were apart. Due to this, the folding arms were under excessive force.

On the other hand, this invention has such complemental elements that at the front end of the integral formed arm there is defined a hole to fix engaging projection and supporting rod therein, to stabilize the folding arm therein, thereby permitting the legs of the folding chairs to be spread. Thus, this invention has better appearance and more rigidity, and may be used with greater stability.

Another feature of this invention comprises foldable supporting means for connecting both tables and folding chairs to each other and for the folding of them oppositely. In conventional foldable supporting means the supporting member is supported by means of a coil spring, elastically mounted on the frame of the folding chairs, to force the table and the chairs to be stretched out and thus pushed inwardly and then folded. The spring and the supporting member being made of metal, if the supporting means should be broken, it could be dangerous to the user. Also it could otherwise be an inconvenience to operate due to the elastic force of the spring.

This invention includes a synthetic resin fixing piece which is slidably mounted at one end of a connecting rod, wherein a tooth is formed at the front end thereof to thereby engage the fixing piece with the tooth on the connecting table and fix it thereto.

Therefore this invention not only has good appearance but also may be smoothly assembled and used in safety.

Further objects and features of this invention will be apparent from the following specification and claims when considered in connection with accompanying drawings illustrating the preferred embodiment of this invention.

BRIEF DESCRIPTION OF THE DRAWINGS

FIG. 4 and FIG. 5 are views showing the jointing of the folding arm and its supporting rod.

FIG. 6 is a side view showing the jointing of the folding arm and its supporting rod.

FIG. 7 is an exploded perspective view showing table-chair connecting rod and the fixing piece before assembly.

FIG. 18 is an exploded perspective view of compartment locking means.

FIG. 19 is an enlarged perspective view of the locking means of FIG. 18.

FIG. 20 is a view illustrating the operation of the locking means of FIGS. 18 and 19.

DESCRIPTION OF THE PREFERRED EMBODIMENT

Figure 1:
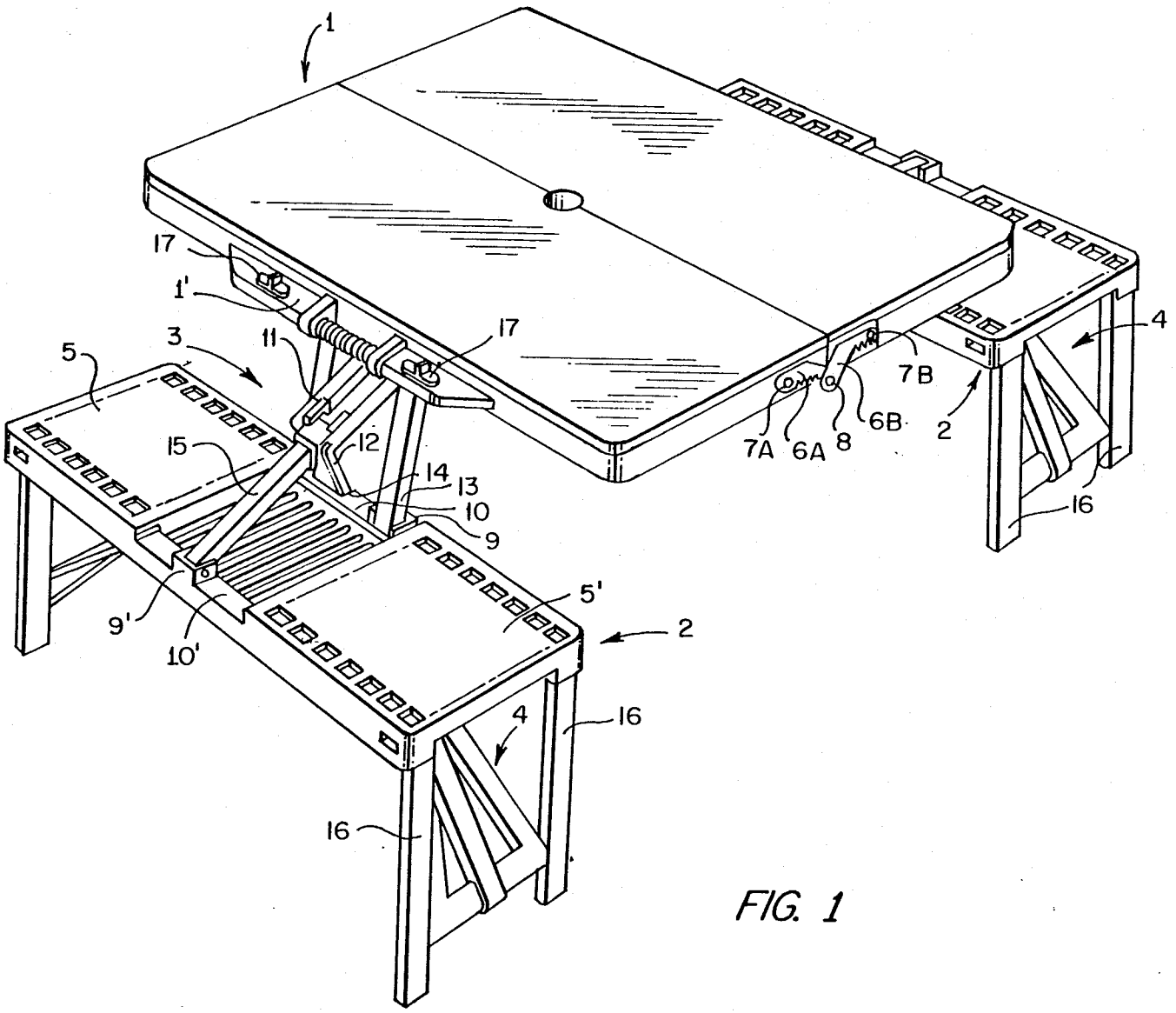
FIG. 1 is a perspective view showing the table being stretched out into utility configuration.

Generally, this invention relates to a table 1 and chair 2 apparatus integrally coupled. It is folded and portable, and at least two components of the table are hingedly connected to each other to form a flat table surface when the apparatus is stretched out or assembled. It can be disassembled and compartmented into a box-like container when folded up.

When it is thus folded, a unique locking means serves to preserve and maintain the shape of the compartment; also respective chair components 2 are hingedly coupled to table components 1 and mounted within the compartment or box, a fixing means serving to locate chair surfaces of respective chair components, which is rotated to an angle of about 180 degrees relative to the box or compartment having the chair components therein. The chairs 2 are adjacently parallel to the flat table surface and fixed by connecting rod 3 in a position which is spaced a predetermined distance from the table. The chair components are provided with leg supporting elements or folding arms 4 which are hingedly and rotatably locked to ends thereof and act to set the chair surfaces being formed as horizontal surfaces. The flat surface of the table is hingedly supported and maintained in stiffness by means of a locking support component which is in a position to be rotated from its locking support attitude and to be folded toward the lower portion of the chair components lying beneath the chair surface.

Referring to FIGS. 2–6 inclusive, at the lower central portion of chair folding arm 4 there is formed groove 4', one side of which is narrowed. Groove 4' has hole 4'' apertured therein so that supporting rod 26 may be rotatably mounted on one surface of both of the side walls at the front end thereof and through hole 28 drilled at both of the side walls respectively in the lowest end thereof. Engaging projection 27 protrudes from both sides of through-hole 28. At one end of the upper surface in the front end of folding arm 4 there is apertured pin engaging hole 29.

Figure 2:
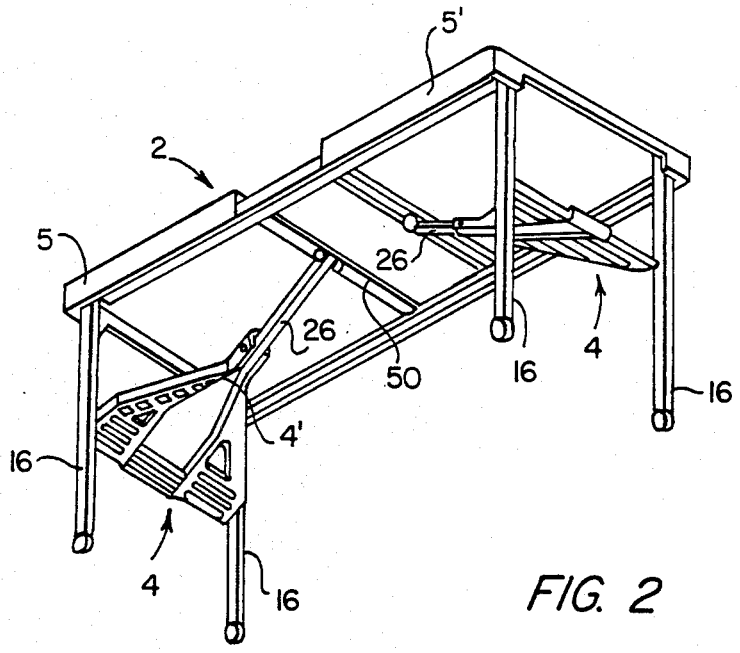
FIG. 2 is a view showing the assembly of one chair frame.
Figure 3:
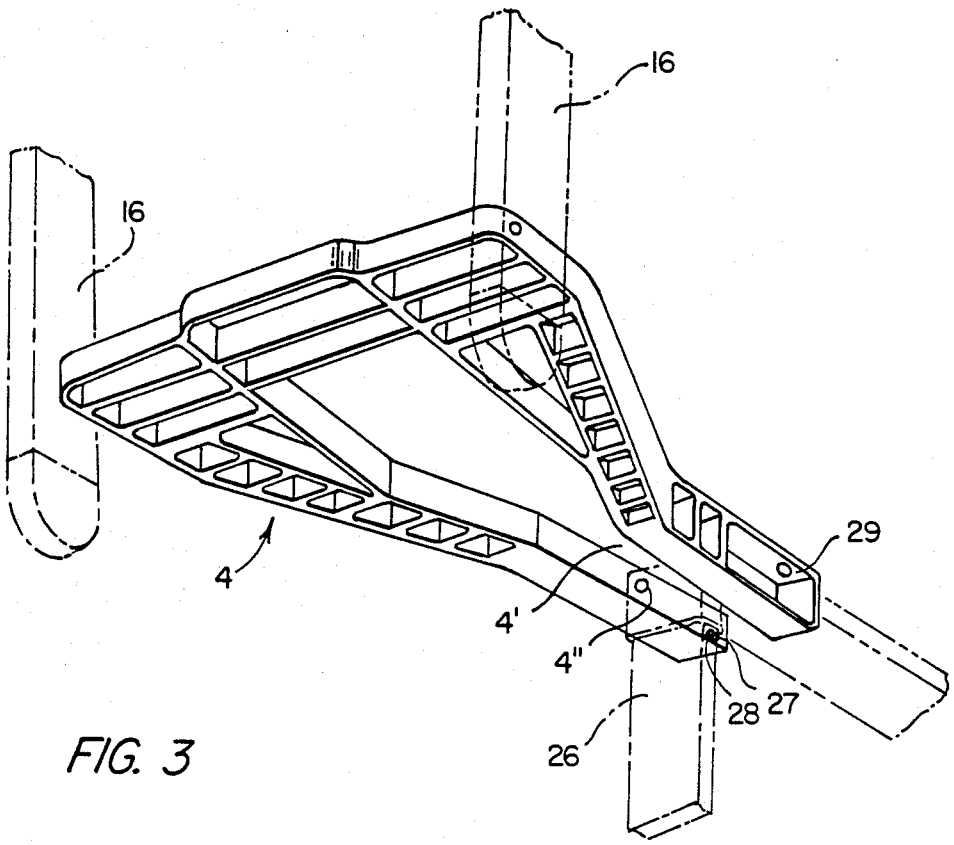
FIG. 3 is a perspective showing the structure of the chair frame folding arm.
Figure 8:
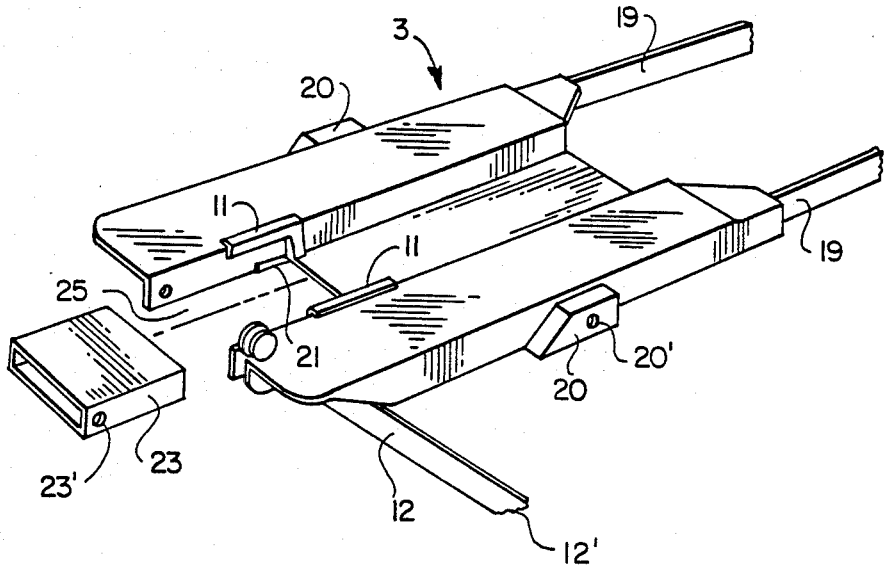
FIG. 8 is a perspective view showing the connecting rod assembly of FIG. 7.

In mounting folding arm 4, as shown in FIG. 2, its other end is stretched in a straight line to supporting rod 26, the rod 26 being rotatably fixed to frame 50 of folding chair 2 and the arm 4 being rotatably mounted to leg 16 of chair 2.

Thus the folding chair is easily folded under a slightly resistant force against engaging projector 27 of folding arm 4, by applying pressure from its lower to the connecting portion of folding arm 4 and supporting rod 26 when folded. According to the folding operation, leg 16 of folding chair 2 is shoved toward the inside of the chair and folding chair 2 is combined with the table.

On the contrary, if a folding chair is stretched, pulled out from the table, and then leg 16 is lifted upwardly in the inside while folding arm 4 and supporting rod 26 are being stretched, then as shown in FIGS. 4 through FIG. 6 supporting rod 26 is contacted by engaging projector 27 of folding arm 4, and then pushed downwardly by slight pressure while completely engaged with engaging projection 27. In such an engagement operation, this is properly accomplished by engaging projector 27 of folding arm 4.

If it is necessary to firmly fix the supporting rod 26 to folding arm 4, the pin is inserted into through-hole 28 apertured at the center of engaging projector 27. Thus one obtains a stabilized chair and by a simplified operation rigidizes it.

Referring to FIG. 1 and FIGS. 7 through 9, a foldable table-chair supporting means 3 connects the table and the respective folding chairs. Protruding portion 20 having through-hole 20' formed at one side thereof, extends from both sides of connecting rod 3. At the central area of one end of connecting rod 3, there is formed a space 25 into which propping rod 23 is slidably inserted. In the upper portion of both spaces 25, protruding end 11 is projected from connecting rod 3 and locking projector 21 is formed in the lower portion of protruding end 11. Groove 22 is formed in one side of space 25 so that fixing piece 12 having tooth 12' at the front end thereof may be rotatably inserted into groove 22.

Figure 9:
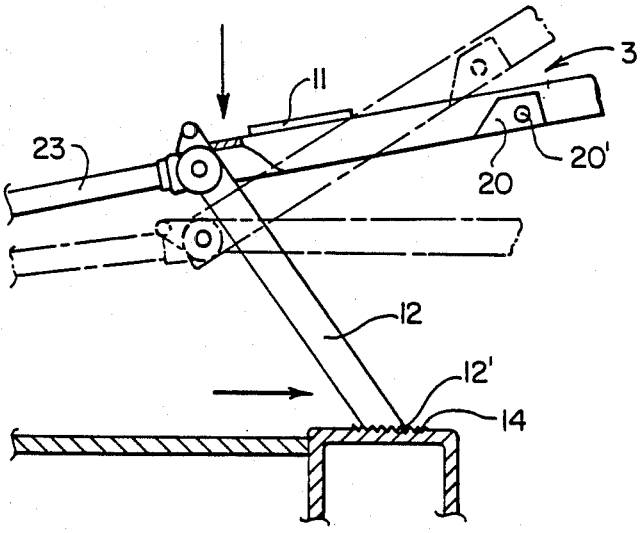
FIG. 9 is a view showing the operation of the components of FIGS. 7 and 8.
Figure 10:
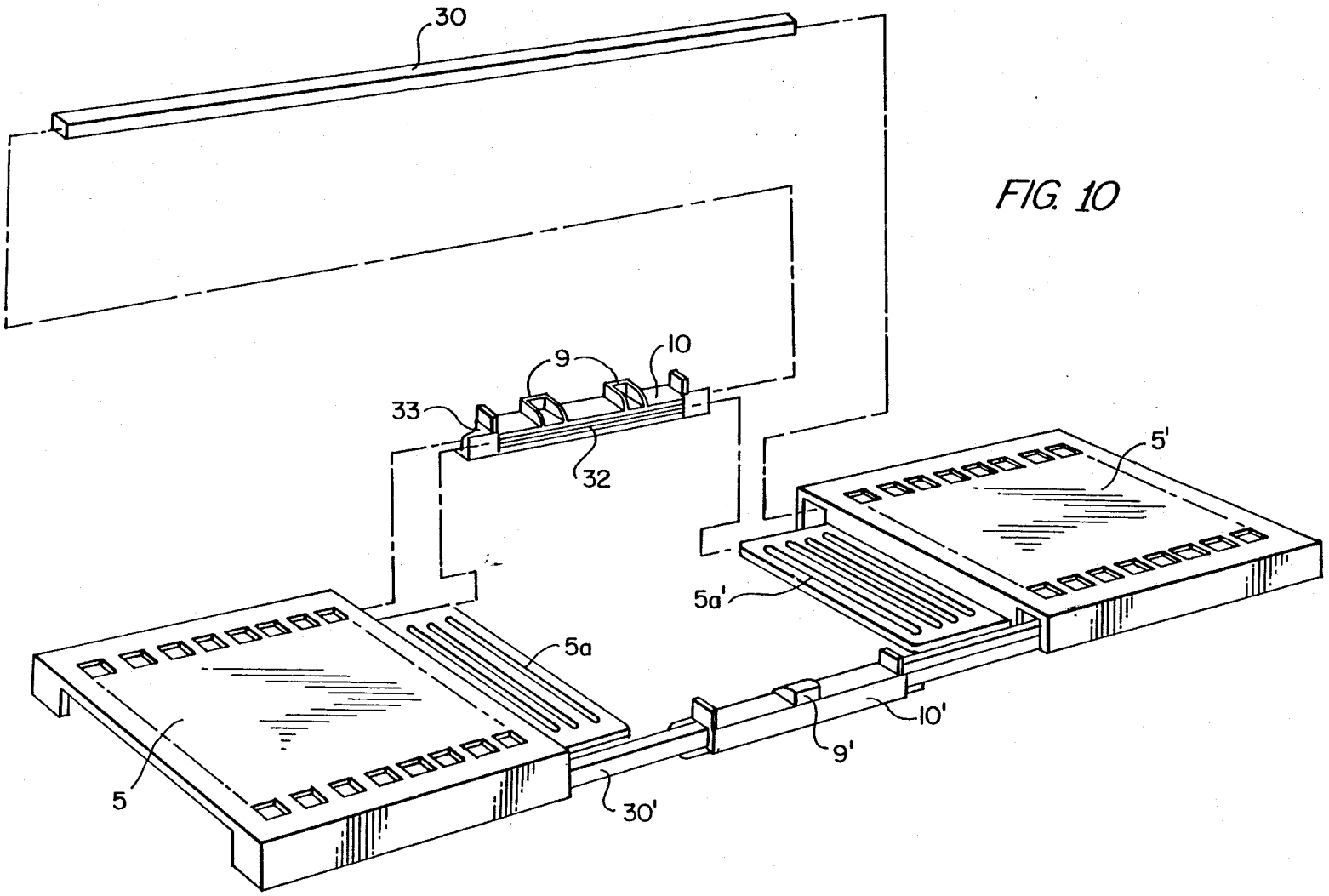
FIG. 10 is an exploded perspective view showing the structure of one seat plate as illustrated in FIG. 1.
Figure 11:
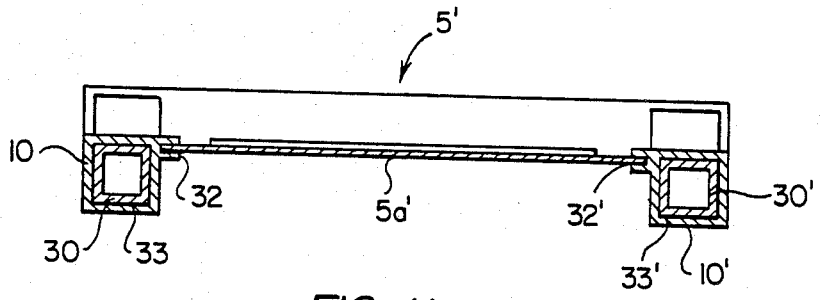
FIG. 11 is a cross-sectional view of seat plate taken along the lines A—A of FIG. 10.
Figure 12:
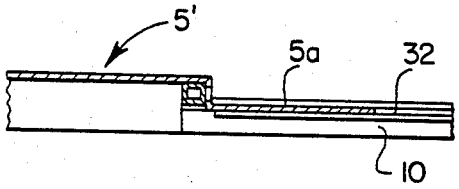
FIG. 12 is a cross-sectional view of seat plate taken along the lines B—B of FIG. 10.
Figure 13:
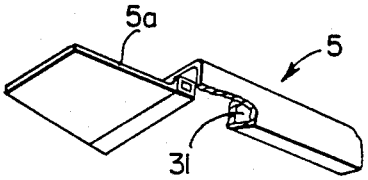
FIG. 13 is a view representing in part the connecting of the lower portion of a jointing plate.

Front end teeth 12' of fixing piece 12 engage with corresponding tooth portions 14 formed at one end of the upper surface of connecting tube 10 of folding chair 2. See FIGS. 8 and 9. Accordingly, when the connecting rod 3 is folded, fixing piece 12 supported on connecting tube 10 of the folding chair 2 beneath connecting rod 3, as shown in FIG. 9, it may be released from the engaged tooth portion of the chair by being pushed inwardly, while connecting rod 3 and propping rod 23 are overlapped as the proper pressure is applied from the upperside of the connecting portion of connecting rod 3 and propping rod 23 to the lowerside of said connecting portion. Then the folding chairs at both sides of table 1 are inserted into table 1 and folded by means of the hinge, thereby forming the portable box-like container.

Also when the table is spread out, the stretching operation is simply conducted contrary to the folding operation. At that time folding chair 2 is pulled out from table 1 so that propping rod 23, connecting piece 19 and supporting rod 13 are spread about the center of the connecting rod 3.

When supporting rod 13 engages hooking projector 21 of connecting rod 3, it applies slight pressure to the connecting rod 3 to set the connecting rod, supporting rod 13 and connecting piece 19 in a straight line. Then supporting rod 13 is hooked onto protruding end 11 in order to avoid rotation upwardly and to prevent its being too easily folded downwardly. Therefore in such a stretching state, fixing piece 12 is rotated downwardly to engage tooth portion 14 of the upper surface in connecting tube 10, thereby supporting connecting rod 3. Thus, the table is not only supported horizontally, but it has a good appearance and flexible set-up.

Referring to FIGS. 1 and 10 through 13, seat plates 5—5' define jointing plates **5*a*, 5*a'* which are extended inwardly. On one side each of connecting tubes 10, 10' are inner holes 33, 33' and shaft supporters 9, 9'. There are also formed therein elongated grooves 32, 32'. See FIG. 11. Jointing tubes 30, 30' are thus inserted into holes 33, 33' of connecting tubes 10, 10' and holes 31, 31' being formed respectively on each of the bottom portion of the plate materials. Jointing plates 5*a*, 5*a'* of the seat are inserted into elongated grooves 32, 32' of connecting tubes 10, 10', respectively. As shown in FIG. 1, frame 13, 15 being connected to table 1 is slidably mounted in shaft supporter 9, 9', of each of the connecting tubes 10, 10'. Leg 16 having folding arm 4** is slidably mounted to the lower portion of the respective seat plates.

Each seat plate is unseen from the exterior because it is assembled by using two plate materials 5, 5' and connecting tubes 10, 10'. The frame of the seat plate includes two jointing tubes 30-301. Also since jointing plates **5*a*, 5*a'* are fitted into connecting tube 10, 10'** securely and tightly, they are easy to assemble.

Connecting rods 10, 10', jointing tubes 30, 30' and plate materials 5, 5' are assembled adjacent each other to provide strong stiffness, reliable stability, a good appearance, and thus one can maximize the use of the space between both of the plate materials, to provide chair seat plates that are more practical than those of the prior art.

Referring to FIGS. 14 through 17, a hinge means includes hinges and engaging portions, wherein hinges 6A, 6B are respectively mounted in hinge grooves 40A, 40B formed on the side surface of table 1. Saw tooth portions 6A'', 6B'' and 40A'', 40B'' are formed on the exterior lower end of hinges 6A, 6B and hinge grooves 40A, 40B to prevent leftward and rightward displacement shaking of these hinges.

Hinges 6A, 6B are thus assembled, respectively, on the side of sections of table 1, engaging portion 41 thereof along with thickness adjusting member 47, using bolt holes 6A', 6B' on one portion thereof, bolt holes 40A', 40B' apertured on one portion adjacent hinge grooves 40A, 40B, bolt holes 6A', 6B' on other portion thereof, bolt holes 40A''' on other portion adjacent hinge grooves 40A, 40B and holes 42, 42' apertured through ring type projector 41A, 41B.

In order to insert hinges 6A, 6B into a proper location at the side of table 1 and fix them, preformed hinge grooves 40A, 40B receiving hinge 6A, 6B are formed on the side of sections of table 1 to present a predetermined depth and width as well as shape corresponding to that of hinge sections 6A, 6B. Adjacent both ends of hinges 6A, 6B there are apertured bolt holes 6A', 6B' on the side of the sections of the table and bolt holes 6A', 6B' on the outside of the folding side portion. Also at hinge grooves 40A, 40B there are drilled bolt holes 40A', 40B', 40A''' corresponding to hinges 6A, 6B, and at engaging portion 41 drilled holes 42, 42', respectively.

Figure 14:
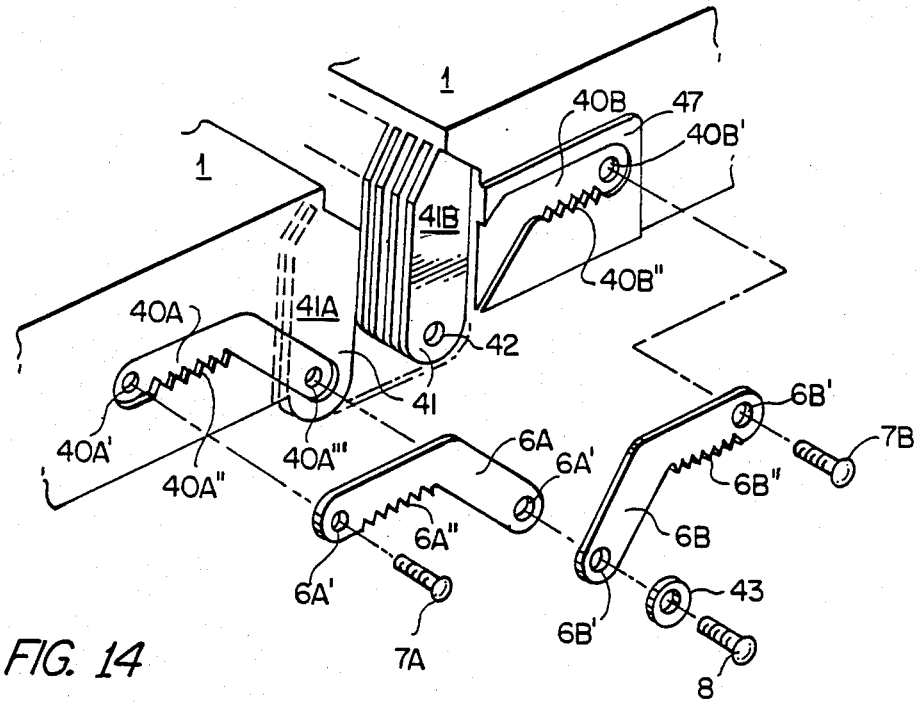
FIG. 14 is an exploded perspective showing table hinge means before assembly.
Figure 21:
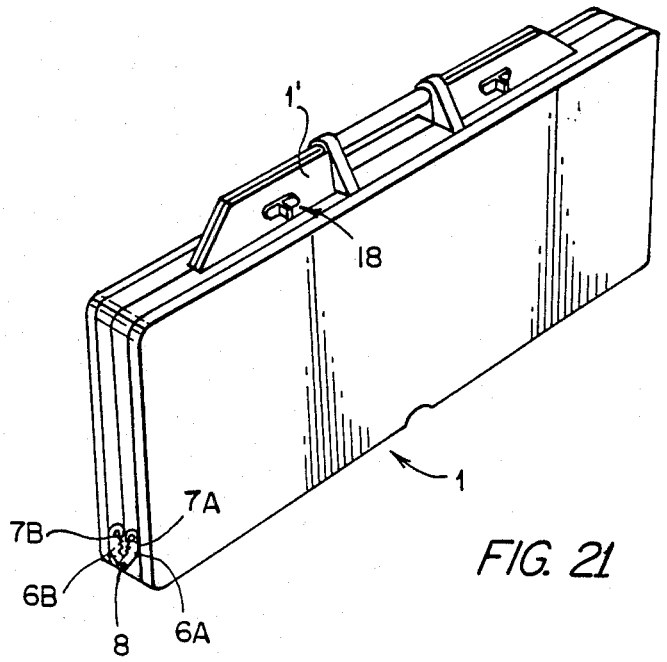
FIG. 21 is a perspective view showing the compartment in box configuration with the table and chairs being completely folded therein.
Figure 15:
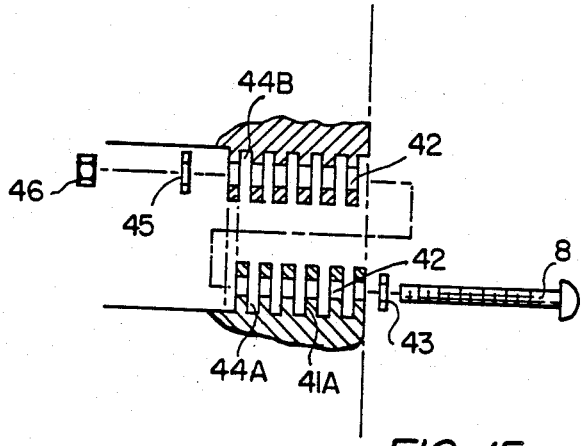
FIG. 15 is a detail cross-sectional view showing an engaging portion coupled to the table hinge means.
Figure 16:
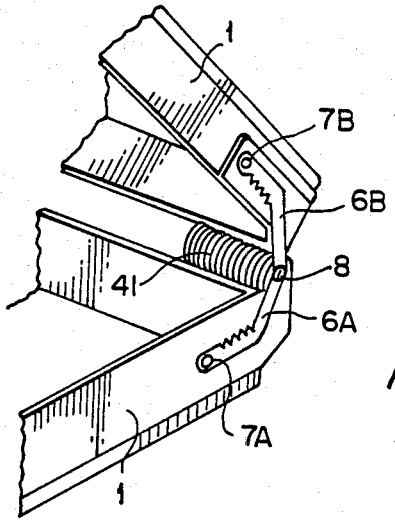
FIG. 16 is a partial perspective view showing the assembly of the table hinge means.
Figure 17:
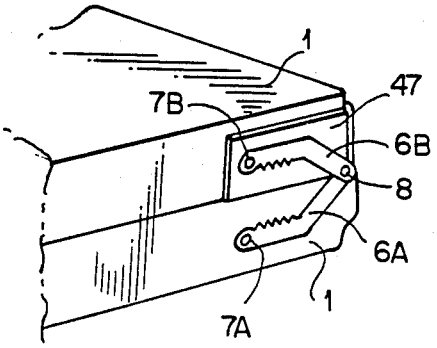
FIG. 17 is a view representing the folding position of the table hinge means of FIG. 16.

As shown in FIGS. 14 and 15, holes 6A', 40A', holes 6A', 40A''' and holes 6A', 40A''', 6B' have bolt 7A and nuts, bolt 7B and nuts and bolt 8 along with washer 43, 45 and 46 inserted therein, respectively.

Also engaging portion 41 comprises ring type projectors 41A, 41B grooves 44A, 44B, central bolt 8, and nut 46 as shown in FIG. 14. Each ring type projector 41A, 41B is integrally attached to the side of table 1. If table 1 sections are folded, each ring type projector 41A, 41B as inserted into each grooves 44A, 44B as shown in FIG. 15 and fixed by means of central bolt 8, inserted slidably through holes 42, 42' on both ring type projectors 41A, 41B and nuts 46. This engaging portion 41 is freely inserted into grooves 44A, 44B according to the folding angle of both of ring type projectors 41A, 41B, independent of its folding angle. Also for overcoming the problem of a difference between its position and a position determined by the thickness of both of ring type projectors 41A, 41B and both of hinges 6A, 6B, thickness adjust member 47 is attached to one side of table 1. As indicated both of hinges 6A, 6B are mounted into hinge grooves 40A, 40B, bolts being inserted into holes on hinges 6A, 6B and holes in hinge grooves 40A, 40B being positioned corresponding to said holes of the hinges. These bolts are fixed to the side of table 1. Also holes 6A', 6B' on one portion of hinges 6A, 6B, hole 40''' in hinge grooves 40A, 40B and hole 42, 42' in engagable portion 41, are brought in line with each other to insert into/fix thereto central bolt 8, along with washers 43, 45 and nut 46. At this time, central bolt 8 is slidably inserted through holes 42, 42' in ring type projectors 41A, 41B into engaging portion 41. Also ring type projectors 41A, 41B are mounted in grooves 44A, 44B opposite each other, respectively, so that engagable portion 41 allows sections of table 1 to be folded easily in half.

Each of hinges 6A, 6B is provided with tooth portions 6A'', 6B'' and 40A'', 40B'' to be inserted into corresponding hinge grooves 40A, 40B, respectively, without being removed and damaged by the exterior impact and the displacement shaking during insertion. Thus these hinges act to safely fold the table. They may be fabricated of plastic integral with the table sections.

Therefore the invention is easy to manufacture, simple to assemble and disengage, convenient to use and maintain, and to carry as a portable table.

Referring to FIGS. 18 through 21, both of handles 1' have holes 1'' respectively apertured therein, slider 18 on one part thereof and fixing mechanism 17 on the other part thereof, the locking means comprising slider 18 and fixing mechanism 17. Slider 18 defines oval plate **18*b*, a handle piece 39, slidably fitted into the hole of one handle. This is provided with engaging projector 18*d* at the inner surface thereof, the front end of which is curved in the form of the hook, to form slanting surface 35 and hooking jaw 34, and the lower and upper surfaces thereof having inclining projectors 36, respectively. Fixing mechanism 17 engages with slider 18 and is fitted into hole 1'' of other handle 1', in which oval plates 17*b* have fixing piece 17*a* formed on respective inner surfaces thereof, the front end of which is provided with slanting surface 35' and hooking jaw 37, and the upper and lower surface of which are provided with inclined projectors 38**, respectively.

Thus if slider 18 and fixing mechanism 17 are pushed against each other, inclining projectors 36, 38 are hooked on the inner surface of hole 1'' in handle 1' so that it may not be removed therefrom. These slider 18 and fixing mechanism 17 both permit engaging projector **18*a* of slider 18 and fixing piece 17*a* of fixing mechanism 17 to contact each other as table 1 may be folded into the form of a box-like container. Then as slider 18 is moved toward a predetermined direction, hooking jaw 34 of engaging projector 18*a* fixedly disengages hooking jaw 37 of fixing piece 17*a*. To release from a locking condition slide 18 is moved in the opposite direction. At this time engaging projector 18*a* is disengaged with fixing piece 17*a*, while table 1** is stretched out or unfolded.

On the other hand, when table such as table 1 was folded into the configuration of a container, in conventional art, the latch and the guide groove must correspond with each other. But in this invention, slanting surfaces 35, 35' respectively formed on the front end of engaging projection **18*a*, and fixing piece 17*a* contact each other. Therefore slider 18 is slid along slanting surfaces 35, 35' to the place that is locked into engaging projector 18*a***. When stretching the table, or unfolding it, the slider is moved in only one direction only. Therefore, assembly and use is rendered very simple and easy.

What is claimed is:

1. A foldable and portable integral table and chairs therefor comprising:

(a) at least two table members hinged together at ends thereof to provide a planar table service and an alternate folded container of box configuration, said table members bearing hinges at opposite ends thereof;

(b) at least two chairs secured in pivotally foldable relation to each said table member to be enclosed in the container, said chairs each forming opposed seat plates with jointing tubes beneath the chair plates, each of said chairs bearing pivotally rotatable and lockable legs at each end thereof, said chair legs being structurally configured to rotate from a locked supporting attitude and to collapsibly fold and nest into said chairs beneath them; the seat plates extending oppositely inward to form opposed jointing plates, the jointing plates bearing connecting tubes, said connecting tubes defining inner channels, shaft supporters and elongated grooves, jointing tubes inserted into the channels of the connecting tubes and the jointing plates being respectively inserted into the elongated grooves of the connecting tubes;

(c) a pivoted folding arm having a groove therein connecting each respective chair and chair leg by means of a chair supporting rod, which is pivoted at opposite upper and lower ends to the chair and the folding arm respectively, the lower end of said supporting rod bearing in the groove of the folding arm; and (d) a foldable connecting rod pivoted between table and chair, the connecting rod having upper and lower ends, the said rod forming at least one protrusion intermediate ends thereof, a propping rod pivoted to the lower end of the connecting rod and a table connecting piece pivoted to the upper end of the connecting piece, said table connecting piece also having pivot connection to the table at its upper end, a fixing piece interconnected to the lower end of the connecting rod, both said propping rod and fixing piece being aligned co-axially in pivotal connection with the lower end of the connecting rod, the fixing piece also having pivotal connection at its opposite end with the table whereby the fixing piece may removably engage a portion of the chair in the assembled condition; a table supporting rod is pivotally mounted at one end to the connecting rod and at another end to the chair.

2. The integral table and chairs of claim 1, wherein the opposed table hinges are respectively mounted in hinge grooves formed on end side surfaces of the table, saw tooth portions thereof being formed on respective exterior lower ends of said hinges, said hinge grooves within the table being formed to prevent lateral displacement of the hinges.

* * * * *